US006218644B1

(12) United States Patent
Zorn et al.

(10) Patent No.: US 6,218,644 B1
(45) Date of Patent: Apr. 17, 2001

(54) MULTIPLE WIRE CORD AND MULTIPLE SEGMENT HEATING ELEMENT FOR FOOTWEAR/OUTERWEAR HEATER

(75) Inventors: Heinz Zorn, Eggersdorf bei Graz; Di Gerhard Schreiner, Graz, both of (AT)

(73) Assignee: Macher & Zorn OEG (AT)

( * ) Notice: Subject to any disclaimer, the term of this patent is extended or adjusted under 35 U.S.C. 154(b) by 0 days.

(21) Appl. No.: 09/498,412

(22) Filed: Feb. 4, 2000

(51) Int. Cl.[7] ..... H05B 1/00

(52) U.S. Cl. ..... 219/211; 219/217; 219/527; 174/36

(58) Field of Search ..... 219/211, 217, 219/528–529, 523, 527, 549; 36/2.6; 174/23 R, 107, 113 C, 36, 131 A, 115; 156/54, 55

(56) References Cited

U.S. PATENT DOCUMENTS

| | | | | |
|---|---|---|---|---|
| 2,028,347 | * | 1/1936 | Pelosi | 219/211 |
| 3,778,590 | * | 12/1973 | Iizuka et al. | 219/211 |
| 4,061,898 | * | 12/1977 | Murray et al. | 219/211 |
| 4,097,686 | * | 6/1978 | Gladenbeck et al. | 174/131 A |
| 4,705,935 | * | 11/1987 | Traffanstedt et al. | 219/211 |
| 4,862,603 | | 9/1989 | Balbinot . | |
| 4,948,951 | * | 8/1990 | Balzano | 219/528 |
| 4,950,858 | | 8/1990 | Slenker . | |
| 5,063,690 | | 11/1991 | Slenker . | |
| 5,140,131 | | 8/1992 | Macher et al. . | |
| 5,159,157 | * | 10/1992 | Diegmann | 174/113 C |
| 5,574,250 | * | 11/1996 | Hardie et al. | 174/36 |

* cited by examiner

*Primary Examiner*—Tu Ba Hoang
(74) *Attorney, Agent, or Firm*—Michael Best & Friedrich LLP

(57) ABSTRACT

A footwear/outerwear heater with a battery cord that includes one or more wires of a first type of wire having a relatively high conductivity, but relatively low tensile strength. The cord also includes one or more wires of a second type of wire having a relatively high tensile strength, but a relatively low conductivity. The wires are positioned adjacent to each other in a sequence where one or more wires of the first type of wire, are sandwiched between two wires of the second type of wire. In another embodiment of the invention, the two types of wire are arranged in concentric forms or braided together. The cord is connected to a heating element that includes a resistive layer positioned between a bottom conductive layer and a top conductive layer. The top conductive layer has multiple segments. Power is selectively applied to the segments to control the amount of heat generated by the heating element.

7 Claims, 3 Drawing Sheets

MULTIPLE WIRE CORD AND MULTIPLE SEGMENT HEATING ELEMENT FOR FOOTWEAR/OUTERWEAR HEATER

BACKGROUND OF THE INVENTION

The present invention relates to footwear and outerwear heaters, and, more particularly, to wiring and heating element configurations for footwear and outerwear heaters.

There are numerous devices for heating shoes, cold-weather boots, ski boots and the like (collectively and generically referred to as "shoes" or "footwear"). Footwear heating devices generally include a heating element embedded or positioned within an insole. The heating element is connected by a cable or cord to a power supply, such as a battery pack. Most often, the power supply is mounted on the outside of the shoe or attached to the clothing of the person wearing the shoe. Heating devices that are similar to those used in footwear may also be fitted in outerwear such as ski jackets, parkas, and snowsuits.

Although present footwear and outerwear heaters are functional, they have several shortcomings. Prominent among these is that most footwear heaters have unacceptably short commercial lifetimes due to failures in their electrical systems. Each time a wearer puts on a shoe, he or she must route the cord connecting the heating element to the power supply out of the shoe to the location of the power supply. Then, the cord must be connected to the battery. The required routing and connecting causes the cord to be repeatedly bent and stretched. Each time the cord is bent or stretched the wire within it is subjected to tensile forces. Often these forces are sufficiently strong to fracture the wire, resulting in an open-circuit condition. Once the wire in the cord is fractured, the cord must be replaced or, if possible, repaired.

The points at which the cord is attached to the heating element are also subject to repeated bending and pulling. The bending and pulling can cause a fracture of the solder joint connecting the cord to the heating element. As with the wire in the cable, when the solder joint is fractured an open circuit condition is created. Again, a fracture or disconnection at the joint with the heating element requires replacement or repair of the heater.

Another deficiency of presently available heating elements relates to controlling the amount of heat generated by the heater. In most heaters, heat output is controlled by adjusting the current flowing through the heating element with a potentiometer or rheostat, While variable resistance devices provide some control of heat output, more precise control is desired.

Accordingly, there is a need for improved cables and heating elements for footwear and outerwear heaters.

SUMMARY OF THE INVENTION

The present invention provides a footwear/outerwear heater with a battery cord that can withstand repeated bending, stretching, and manipulation by a user without failing. In one embodiment of the invention, the cord includes a plurality of strands of conductive material such as wire. The wires are positioned adjacent to each other in a sequence where one or more wires of a first type of wire, having a relatively high conductivity, are sandwiched between wires of a second type of wire, having a lower conductivity, but a greater tensile strength. In another embodiment of the invention, the cord includes one or more braided or concentrically arranged wires. The cord includes a first type of wire, having a relatively high conductivity, and a second type of wire, having a lower conductivity, but a greater tensile strength. The second type of wire is positioned concentrically to or braided with the first type of wire.

The cord is connected to a heating element. The heating element includes two conductive layers and a layer of resistive material sandwiched between the conductive layers. The conductive layers are made from a relatively thin, flexible material such as a metal foil and connected to the wires in the cord by soldering or welding. One of the conductive layers includes two segments. The first segment has a first size and the second segment has a second, larger size. Power may be applied to the first segment, the second segment, or both of the segments. By selectively providing power to the segments the amount of heat provided by the heater may be adjusted. When power is supplied solely to the smallest segment, the least amount of heat is generated. When power is supplied solely to the second, larger segment, a greater amount of heat is generated. When power is supplied to both segments, maximum heat is generated.

Other features and advantages of the invention will become apparent by consideration of the detailed description and accompanying drawings.

DETAILED DESCRIPTION

Figure 1:
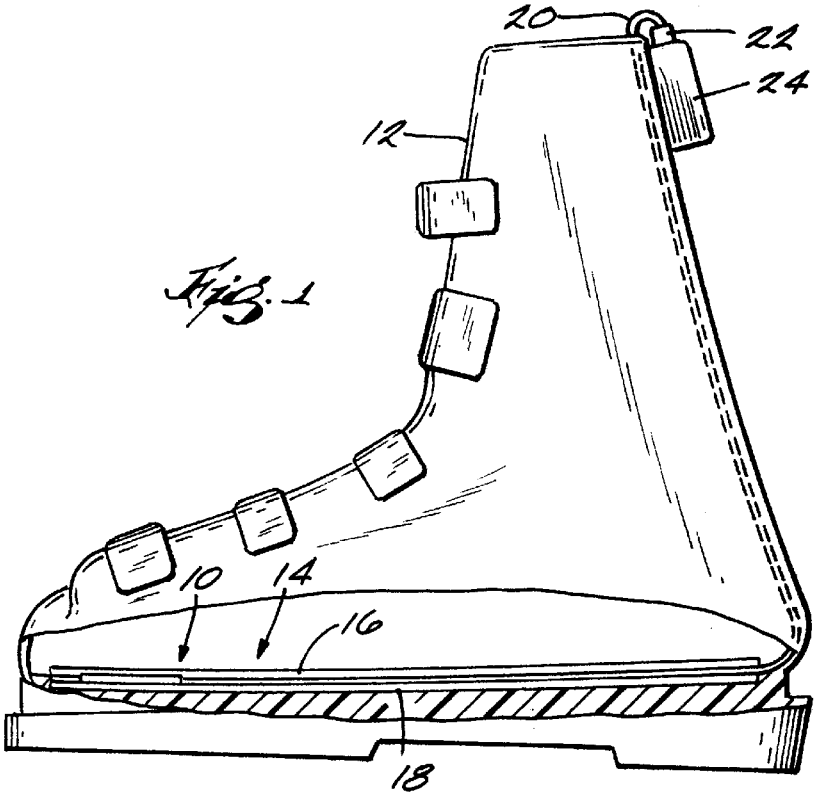
FIG. 1 is a perspective, partially cut-away view of a ski boot having a heating device constructed in accordance with the invention.
Figure 2:
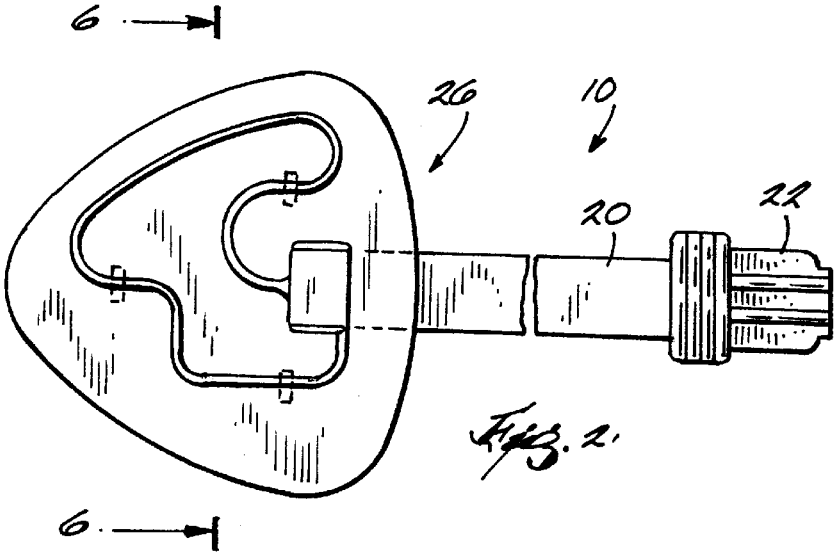
FIG. 2 is a top view of the heating device shown in FIG. 1.
Figure 3:
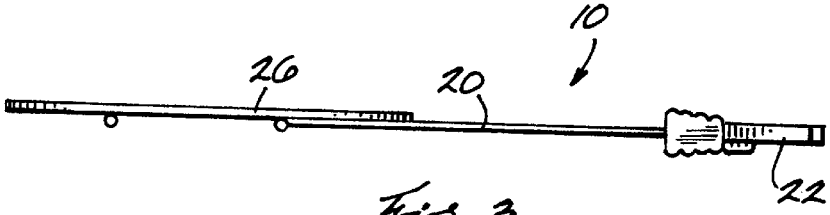
FIG. 3 is a side view of the heating device shown in FIG. 1.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

A heating device 10 embodying the invention is shown positioned in a ski boot 12 in FIG. 1. As indicated above, the heating device 10 may be used in a variety of footwear and possibly in clothing and outerwear. Accordingly, the invention is not limited to the exemplary ski-boot application described and illustrated. The heating device 10 is positioned in an insole 14. Preferably, the heating device is placed between an upper layer 16 and a lower layer 18 of the insole 14. A cable or cord 20 having a connector 22 connects the heating device 10 to a power supply 24, such as a battery pack.

Figure 6:
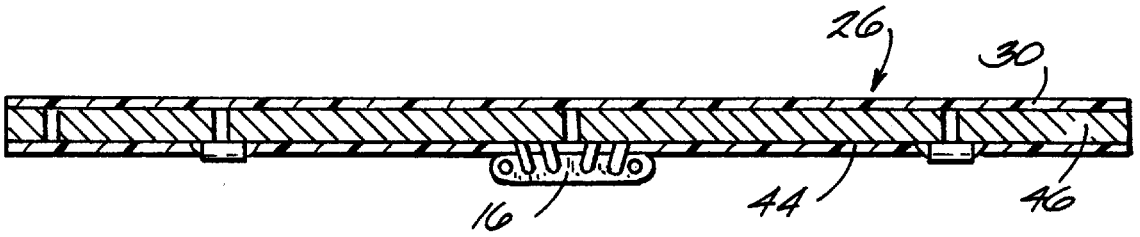
FIG. 6 is a cross-sectional view of the heating element of FIG. 1 taken along the line 6—6 in FIG. 2.
Figure 7:
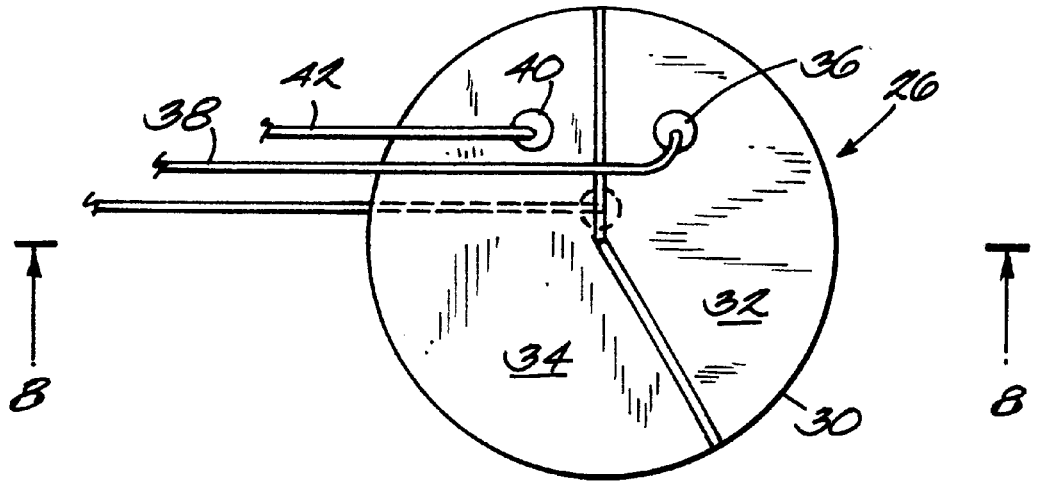
FIG. 7 is schematic diagram of the heating element of FIG. 1 illustrating its multiple sections.
Figure 8:
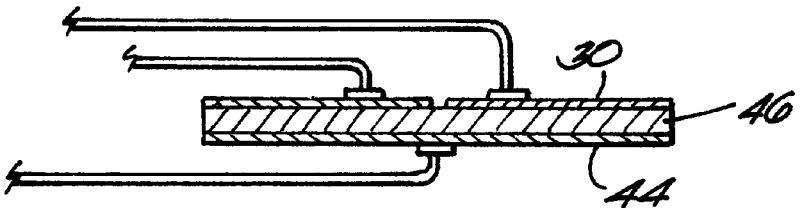
FIG. 8 is a schematic, cross-sectional view of the heating element of FIG. 7 illustrating the electrical connection of the multiple segments and taken along the line 8—8 of FIG. 7.

The heating device 10 has a heating element 26 that includes a top or first conductive layer 30 (FIG. 6). Preferably, the first conductive layer 30 is made from a thin, flexible material such as a copper foil with a thickness of 0.1 millimeters (mm). The first conductive layer 30 is divided or partitioned into two segments: a first segment 32 and a second segment 34 that is larger than the first segment 32. The first segment 32 has a terminal 36 connected to a positive lead wire 38 from the cord 20. Similarly, the second segment 34 has a terminal 40 connected to a positive lead wire 42 of the cord 20. Power is selectively applied to the segments 32 and 34 to control the amount of heat generated by the heating element 26 using a three-way switch (not shown). Of course, other devices such as a programmable microprocessor (also not shown) could be used to selectively apply power to segments 32 and 34. When power is supplied solely to the first (and smallest) segment 32, the least amount of heat is generated. When power is supplied solely to the second, larger segment 34, a greater amount of heat is generated. When power is supplied to both segments 32 and 34, a maximum amount of heat is generated.

The heating element 26 also includes a bottom or second conductive layer 44. Preferably, the second conductive layer 44 is made out of a metal foil that is identical to the foil used in the first conductive layer 30, except that the second conductive layer 44 consists of a single piece rather that multiple segments. Sandwiched between the first conductive layer 30 and the second conductive layer 38 is a resistive layer 46. The resistive layer 46 may be a metal-filled resin, such as a layer of polyanilin with dispersed metal filings or similar material. Preferably, the resistive layer 46 is between 0.03 and 0.5 mm thick and has a conductivity of between about $10^{-9}$ S/cm and about $10^{-2}$ S/cm. The resistive layer 46 may be screen printed.

Figure 4:
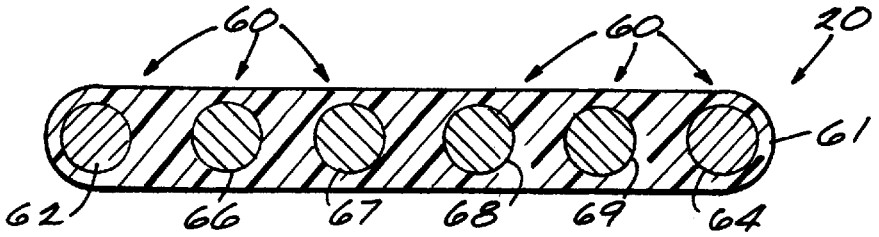
FIG. 4 is a cross-sectional view of a cord used to connect the heating device to a power supply.

The cord 20 is designed to withstand repeated bending, stretching, and manipulation by a user without failing. In the embodiment shown in FIG. 4, the cord 20 includes six wires 60 in a protective sheath or cover insulation 61. The cover insulation 61 may be made from various polymeric materials, but is preferably made from polyvinylchloride (PVC). The wires 60 are positioned adjacent to each other in a linear sequence where two outer wires 62 and 64 are made from a first material that has a relatively high tensile strength. Preferably, the wires 62 and 64 are made from steel. Four wires 66, 67, 68, and 69 are positioned or sandwiched between the outer wires 62 and 64. The wires 66–69 are made of a material having a relatively high conductivity, such as copper. The steel wires 62 and 64 have a lower conductivity than the copper wires 66–69. However, the steel wires 62 and 64 are better able to withstand bending and stretching than the cooper wires 66–69. Therefore, the wires 62 and 64 protect the wires 66–69 against fracture. Any loss of electrical efficiency caused by using the steel wires 62 and 64 is offset by the increased ability of the cord to withstand bending and stretching. Further, since only two of the six wires 60 have a relatively low conductivity, electrical losses are relatively low.

Figure 5:
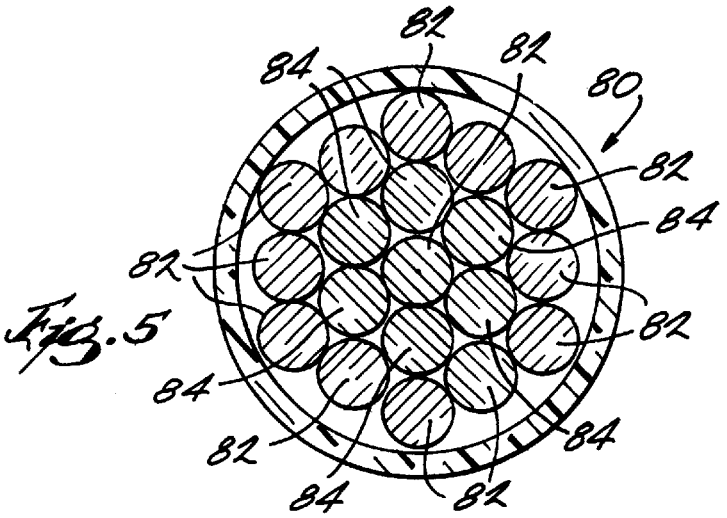
FIG. 5 is a cross-sectional view of another embodiment of the cord used to connect the heating device to a power supply.

Another embodiment of the invention is shown in FIG. 5. The heating element 26 may be connected to the power supply 24 using a cord 80. The cord 80 includes a plurality of a first type of wires 82. The plurality of a first type of wires 82 (except one central wire) is arranged in a circular form. The cord 80 also includes a plurality of a second type of wires 84. The plurality of second type of wires 84 is arranged in a circular form that is concentric to the circular form of the plurality of the first type of wires. The second type of wires 84 are made from a material having a relatively high conductivity, but low tensile strength, such as copper. The first type of wires 82 are made from a material that has a relatively high tensile strength, but lower conductivity, such as steel. The wires 82 and 84 are positioned in a tight, concentric configuration such that the surfaces of the wires contact one another. Alternatively, the wires 82 and 84 could be braided or twisted together in a conventional manner.

When the cord 80 is subjected to bending and stretching, the copper wires 82 fracture before the steel wires 84. Current conduction is interrupted in any copper wires 82 that are fractured. The steel wires 84 provide electrical bridges over the fractures in the copper wires 82. Specifically, when a fracture occurs, current travels from the point of a fracture in a copper wire 82 through an adjacent steel wire 84 for a short distance to the other side of the fracture and then resumes travelling in the copper wire. Since the conductivity of the steel wire is lower than the conductivity of the copper wire, electrical efficiency decreases when current travels in the steel wire 84. However, the alternative conduction path provided by the steel wire 84 is relatively short. Thus, overall electrical efficiency is only slightly reduced.

As can be seen from the above, the present invention provides improved cord and heating element arrangements for a footwear/outerwear heater.

It should be apparent to those of ordinary skill in the art that the features of the embodiment described herein could be combined. For example, multiple wires having the configuration shown in FIG. 5 could be used in a cord having the configuration shown in FIG. 4. Various features and advantages of the invention are set forth in the following claims.

What is claimed is:

1. A footwear/outerwear heater power cord comprising:

a plurality of a first type of wires having a predetermined tensile strength and a predetermined conductivity; and a plurality of a second type of wires having a second tensile strength that is less than the predetermined tensile strength of the first type of wires and a conductivity that is greater than the predetermined conductivity of the first type of wire.

2. A cord as claimed in claim 1, wherein the first type of wire is steel wire and the second type of wire is copper wire.

3. A cord as claimed in claim 1, wherein the pluralities of first and second types of wires are positioned in a concentric arrangement.

4. A cord as claimed in claim 3, wherein the plurality of first and second types of wires are positioned such that the first type of wires forms the outermost circular arrangement in the cord.

5. A cord as claimed in claim 1, wherein the first and second types of wires are arranged in a linear sequence and where a plurality of the second type of wires is sandwiched between a first wire of the first type of wires and a second wire of the first type of wires.

6. A cord as claimed in claim 5, wherein the pluralities of the first and second type of wires are positioned in a cover insulation.

7. A cord as claimed in claim 6, wherein the cover insulation is made from PVC.

* * * * *